United States Patent [19]

Chompff

[11] Patent Number: 4,919,619

[45] Date of Patent: Apr. 24, 1990

[54] LOCAL AREA NETWORK TRANSCEIVER CABLE LOCK

[75] Inventor: Conrad Chompff, Concord, Calif.

[73] Assignee: A 'n D Cable Products, Inc., Concord, Calif.

[21] Appl. No.: 330,146

[22] Filed: Mar. 29, 1989

[51] Int. Cl.[5] ..... H01R 13/639

[52] U.S. Cl. ..... 439/371

[58] Field of Search ..... 439/347, 352, 569, 570, 439/371, 372, 357, 680, 152; 279/1 K

[56] References Cited

U.S. PATENT DOCUMENTS 3,400,361 9/1968 Okun ..... 439/372 X 4,768,974 9/1988 Cowan et al. ..... 439/371

*Primary Examiner*—Z. R. Bilinsky

*Attorney, Agent, or Firm*—Mark C. Jacobs

[57] ABSTRACT

A device for retaining slidelock electrical connectors in mating arrangement with the studs for receiving same such that the electrical connection pins remain engaged for good contact. The device includes a flexible elongated body member with a cable mounting means at one end and a pair of spaced prongs at the other end, said prongs extending in the same direction as the body member, with one of said prongs having an inwardly directed boss at the end thereof.

11 Claims, 1 Drawing Sheet

LOCAL AREA NETWORK TRANSCEIVER CABLE LOCK

FIELD OF INVENTION

This invention pertains to cable ties and related articles and to computer peripherals.

BACKGROUND OF THE INVENTION

Many persons in the computer field are familiar with the slidelock connectors used in connection with transceivers employed in local area networks. These connectors in addition to the pins used for electrical contact have a slidable locking mechanism that engages a pair of spaced posts in accordance with IEEE standard 802.3. The problem that computer users face is that these slidelock connectors are not fail safe and thus they tend to become unlatched from the posts.

Cable ties are well known in the electrical and electronics art for retaining a plurality of wires or cables in a neat closely packed relationship. Cable ties comprise elongated nylon body members having a taper end at one end and a loop at the other end to receive the tapered end. Unidirectionally facing spaced burrs or stops are found on the elongated body which will pass through the loop going forwardly but which will not pass therethrough going rearwardly. Thus cable ties not being reusable and being intended primarily only for use to hold wires, conduits or cables and accordingly cannot be readily adopted to retain the slidelock connectors in place to ensure positive contact at all times.

It is thus seen that there is a need for an auxiliary device that will secure the slidelock in place and prevent it from becoming disconnected physically which in turn can lead to electrical disconnection of one or more of the pins of the slidelock connector.

An object therefore of this invention is to provide a local area network transceiver cable slidelock connector retainer.

Another object is to provide a retention device for LAN transceiver slidelock connectors that can be readily attached in place.

Still another object is to provide a slidelock retainer that is low in cost and can be reused indefinitely.

Yet another object is to provide a slidelock retainer that can be permanently placed on the cable attached to the connector for the LAN transceiver.

A further object is to provide a low cost mass producible slidelock retainer that positively grips the slidelock to prevent it from self-releasing.

Other objects of the invention will in part be obvious and will in part appear hereinafter.

The invention accordingly comprises the product possessing the features, properties and the relation of components which are exemplified in the following detailed disclosure and the scope of the application of which will be indicated in the claims.

For a fuller understanding of the nature and objects of the invention, reference should be had to the following detailed description taken in connection with the accompanying drawings.

SUMMARY OF THE INVENTION

A device for retaining slidelock electrical connectors mounted on either a male or female electrical connector in mating arrangement with the studs for receiving same, which studs are spaced on opposite sides of an electrical connector of the opposite gender as the connector incorporating the slidelock such that the electrical connection pins remain engaged for good contact. The device includes a flexible elongated body member with a cable mounting means at one end and a pair of spaced fingers at the other end, said fingers preferably extending in the same direction as the body member, with the outer of said flanges preferably having an inwardly directed boss at the en thereof.

The device is utilized primarily for the connection of cables having a female 15 bore electrical connector with a slidelock thereon for connection to a male 15 pin connector with the aforementioned spaced studs for the hookup of computer local area networks.

DESCRIPTION OF THE PREFERRED EMBODIMENT

Figure 1:
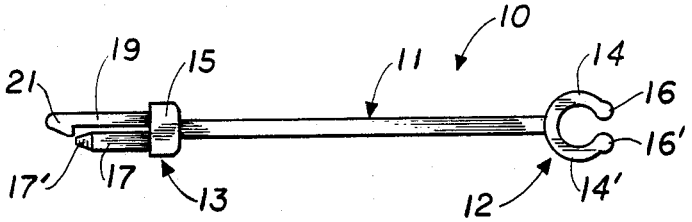
FIG. 1 is a top plan view of the first embodiment of the device of this invention.

The reader is first directed to FIG. 1 where the first embodiment of the instant device is seen. Device 10 includes an elongated flexible main body portion 11, a cable mounting portion 12 and a slidelock retention portion 13, on the opposite end.

Figure 5:
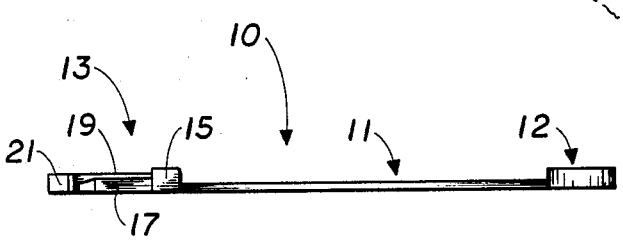
FIG. 5 is a left side elevational view of the device of FIG. 1.

Main body portion 11, also seen in FIG. 5 is preferably of a less thickness than portions 12 and 13. The thinner body portion aids in flexibility a feature necessary for the operation of the instant device while removing the chance of loss of the device, as well as to lower cost through the use of less material. Main body portion 11 and the remainder of device 10 may be made of nylon or some other dielectric low cost plastic.

Cable mounting portion 12 disposed at one end of the main body portion is in the first embodiment, horseshoe shaped. See FIG. 1. This portion includes a pair of mirror image opposed arcuate branches 14, 14'; each of which has a short generally rectangular arm 16, 16' extending outwardly therefrom, said arms being disposed parallel to each other. A keyway opening 18 between said branches and said arms is adapted to receive the jacket of a cable therein. Since the two branches 14, 14' are somewhat resilient, they can be spread apart to receive a cable.

The slidelock retention portion 13 includes a head section 15 which may be generally rectangular and which is attached to the main body portion. Extending axially therefrom in the same plane as the elongation of the main body portion are a spaced pair of locking fingers, an inner finger 17 and an outer finger 19. Inner finger 17 is a generally rectangular solid with the longer dimension running with the length of the device. Finger 17 preferably tapers to a pointed distal end 17' and is spaced slightly from outer finger 19. Outer finger 19 is slightly longer than and parallel to inner finger 17 per FIGS. 1 and 5. Outer finger 19 is also slightly narrower in width, but thicker than finger 17, per FIG. 5. Finger 19 preferably terminates in a generally right angle triangular boss 21, commencing at a point just beyond the extension of finger 17.

In a typical embodiment, main body portion may be about 2.5 inches long, while cable mounting portion 12 may be about 0.5 inches long. Slidelock retention portion 13 may extend out about 0.875" ($\frac{7}{8}$") from the point of origin at the main body portion. Typically each of the two fingers therein extend $\frac{1}{2}$" and 11/16" inches respectively from said head section 15.

Figure 6:
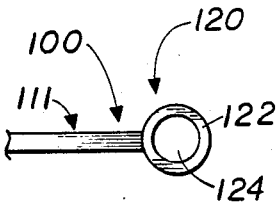
FIG. 6 is a top plan view of part of a second embodiment of the device of this invention.

Reference should now be made to FIG. 6, wherein a portion of the second embodiment 100 of this invention is seen in top plan view. Here, the omitted end corresponds in all details to slidelock retention end 13 previously discussed. The main body portion is here designated 111 and in all ways is the same as main body portion 11 of the first embodiment. Therefore there will be no discussion of that end of this second embodiment. The difference in the two units lies in the cable mounting portion. Here the cable mounting portion 120 is comprised of an annular member 122 having an internal opening 124. Typically opening 124 is about $\frac{1}{2}$" in diameter. Whereas portion 12 is intended to be applied to a cable after cableconnector assembly, portion 120 is intended to be placed on the cable prior to assembly of the connector thereto. The first embodiment permits removal of the device from the cable either accidentally or intentionally, while the second embodiment 120 is permanently mounted to the cable.

Figure 2:
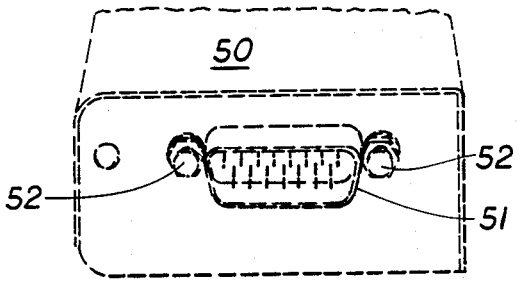
FIG. 2 is a rear perspective view of a LAN transceiver showing the two studs disposed on the opposite sides of the male 15 pin connector for receipt of a slidelock electrical connector.
Figure 7:
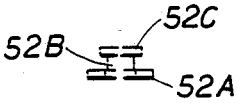
FIG. 7 is a diagrammatic closeup view showing utilization of the device of this invention.

While the diameter of the opening 124 has been stated, there is no criticality to same, and larger and smaller diameters and differing shapes are contemplated to suit any type of wiring even flat ribbon cable. FIG. 2 is a rear perspective view of part of a typical conventional transceiver 50 that employs a slidelock connector. Here transceiver 50 such as those made by Ungermann-Bass, Inc. includes a single conventional trapezoidal male 15 pin connector 51 having a pair of uniformly spaced studs, 52, one on each side thereof. A single such stud is shown in FIG. 7. The stud 52 includes body disc 52A upon which is mounted a cylindrical shaft 52B, which in turn has disposed thereon at the opposite end thereof, a second or distal disc 52C of a diameter smaller than the diameter of 52A.

Figure 3:
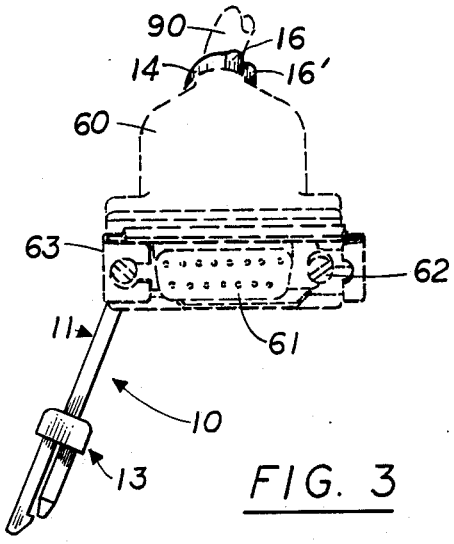
FIG. 3 is a top perspective view of a 15 pin female slidelock connector with the device of FIG. 1 mounted thereto.
Figure 8:
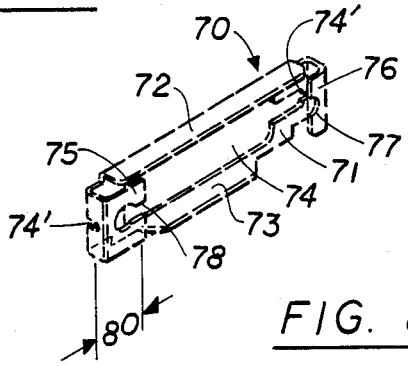
FIG. 8 is a front perspective view of a typical prior art slidelock mechanism utilized in conjunction with this invention.

FIG. 3 is a top perspective view of a conventional 15 hole female connector 60 disposed upon a cable 90. Connector 60 comprises a trapezoidal mating portion 61, a pair of spaced mounting bolts 62 spaced equally from said mating portion 61 on opposite sides thereof and a slidelock 63. Such units can be purchased from many vendors including ICC among others. Discussion of how the device of this invention fits into or operates with the connector 60 will be set forth below, after the discussion of what is a slidelock. Therefore reference is now made to FIG. 8 which illustrates the typical conventional slidelock.

Slidelock 70 is seen to comprise a main body section 71, of a generally planar rectangular configuration, which body section has a forwardly extending normally disposed top flange 72 and a forwardly extending normally disposed bottom flange 73, of a smaller width than the top flange 72. Main body section 71 also includes a generally rectangular center cutout 74, with 2 tangential smaller circular cutouts 74' communicating therewith, one on the left side and one on the right side thereof.

A generally U-shaped (—as seen from the top—) flange 75 having a keyway opening 78 on the forward arm thereof extends from the one end of said main body section, and a mirror facing U-shaped (—as seen from the top—) flange 76, extends outwardly from the opposite side of said main body section. This flange has an arcuate cutout 77 which extends inwardly and parallel to main body section and is of a smaller diameter than the circular part of the keyway opening 78.

Figure 4:
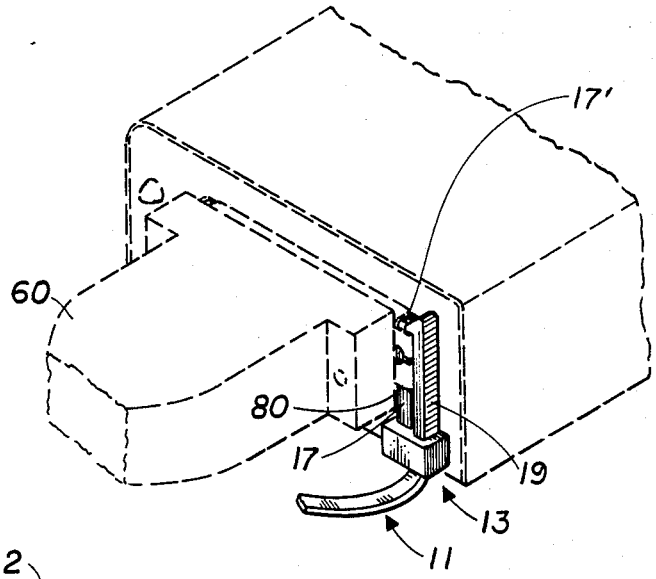
FIG. 4 is a perspective view showing a cable mounted female slidelock connector in mating engagement with the male connector mounted on a LAN transceiver.

Reference should now be made back to FIG. 3. Here the first embodiment of this invention is shown inserted into the slidelock 63. It is understood that this view does NOT illustrate the mode of use but is for illustrative purposes. Actual usage of the device is shown in FIG. 4.

OPERATION AND UTILIZATION

Prior to using the device of this invention, the female multihole electrical connector is physically engaged to the male multipin electrical connector. See FIG. 8. The IEEE 802.3 standard slidelock 70 is slid into a locked position such that the right side larger U-shaped flange 75 engages the cylindrical shaft 52B of the adjacent stud 52 and on the left side the smaller U-shaped flange 76 engages the other cylindrical shaft 52B under its head 52C.

Once the slidelock connection has been made, the shorter or inner finger 17 is inserted into the gap 80 between the outer edge of bottom flanges 73 of the slidelock 70 and right side U-shaped flange 75. Since finger 17 preferably has a tapered distal end 17' easy entrance is assured. Outer finger 19 will spread apart as may be needed such that its boss 21, will lie adjacent the outer vertical edge of flange 76. When adequate force is exerted upon the retention means, the finger 17 will be inserted up to its interface with head section 15. This will permit the flexible outer finger's boss 21 to snap into place underneath flange 76 such that the finger 19 can now lay flat adjacent to the outer edge of flange 76.

The entire operation takes about 15 seconds or less to perform. Once inserted device 10, and device 100 prevent the slidelock from reversing direction to thereby permit uncoupling of the two mated connectors. To remove device 10 or device 100, one merely reverses the procedure, by moving boss 21 outwardly, and pulling up on the main body portion of the device to remove it from engagement within gap 80.

Cable mounting portion 12 is merely forced onto a cable by spreading the two arcuate branches thereof apart as is readily understood. On the other hand, cable mount portion 120 of device 100 is intended to have the cable 90 threaded therethrough prior to assembly of the connector thereupon. Needless to say that while IEEE standards may exist insofar as transceivers and LANs are concerned, there is no criticality for the purpose of this invention as to whether the cable includes the multiholed female connector as shown here; or the multipin male connector with the slidelock thereupon.

It is seen that I have provided a low cost easy to use, easy to remove, reusable slidelock retainer.

Since certain changes may be made in the above product without departing from the scope of the invention involved, it is intended that all matter contained in the above description and shown in the accompanying drawings shall be interpreted a illustrative and not in a limiting sense.

I claim:

1. A device for preventing the accidental release of the electrical connection between a multihole female electrical connector from its counterpart multipin male connector, which connection is to be maintained by the disposition of an IEEE 802.3 standard slidelock, which slidelock includes a side mounted U-shaped flange on each side thereof, a bigger one and a smaller one and which slidelock is disposed on one of said connectors in engagement with one of a pair of spaced posts disposed spaced from the connector not having the slidelock thereupon;

which device comprises a slidelock retention means which engages said slidelock and is interposed between the smaller of said U-shaped flange and one of either the top or bottom flanges and one of said studs, wherein the slidelock retention means comprises:

a head section which may be generally rectangular and which is attached to the main body portion, extending axially therefrom are a spaced pair of parallel locking fingers, an inner finger and an outer finger.

2. The device of claim 1 including an elongated planar flexible main body portion attached to said slidelock retention means.

3. The device of claim 2 wherein a cable mounting portion is secured to the opposite end of said planar main body portion.

4. The device of claim 3 wherein the cable mounting portion is an annular ring.

5. The device of claim 3 wherein the cable mounting portion is horseshoe shaped and comprises a pair of mirror image arcuate branches.

6. The device of claim 5 wherein the entire device is made of nylon.

7. The device of claim 1 wherein the device is made of nylon.

8. The device of claim 1 wherein the inner finger is generally rectangular with the longer dimension running with the length of the device, and tapering to a pointed distal end.

9. The device of claim 8 wherein the outer finger is slightly longer than the inner finger, and is also slightly narrower in depth.

10. The device of claim 9 wherein the outer finger terminates in a generally right angle triangular boss commencing at a point just beyond the extension of the inner finger.

11. The device of claim 4 wherein the entire device is made of plastic.

* * * * *